US009859072B2

(12) United States Patent
Rong et al.

(10) Patent No.: US 9,859,072 B2
(45) Date of Patent: Jan. 2, 2018

(54) WATERPROOF BUTTON AND ELECTRONIC DEVICE USING SAME

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventors: Yu-Jie Rong, Zhengzhou (CN); Yun-Zhi Zhang, Zhengzhou (CN); Xi-Juan Luo, Zhengzhou (CN)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/171,029

(22) Filed: Jun. 2, 2016

(65) Prior Publication Data

US 2017/0287656 A1 Oct. 5, 2017

(30) Foreign Application Priority Data

Mar. 30, 2016 (CN) ..... 2016 1 0189823

(51) Int. Cl.
*H01H 13/06* (2006.01)

(52) U.S. Cl.
CPC ..... *H01H 13/06* (2013.01); *H01H 2229/044* (2013.01)

(58) Field of Classification Search
CPC .... H01H 13/06; H01H 2229/044; H01H 3/12; H01H 3/00; H01H 9/00; H01H 9/02; H01H 9/04; H01H 9/041; H01H 13/50; H01H 13/00; H01H 13/02; H01H 13/54; H01H 2003/12; H01H 2235/004; H01H 13/063; H01H 13/14; H01H 2009/048; H01H 2009/04; H01H 2221/06; H01H 2223/002; G04B 29/00
USPC ..... 200/302.2, 237, 238, 293, 302.1, 303, 200/329, 333, 341, 345; 368/289, 290, 368/291, 292, 319
See application file for complete search history.

(56) References Cited

U.S. PATENT DOCUMENTS 4,417,113 A * 11/1983 Saito ..... G04B 37/106 200/302.2
5,545,865 A * 8/1996 Gotou ..... H01H 13/14 200/341

(Continued)

*Primary Examiner* — Anthony R. Jimenez
(74) *Attorney, Agent, or Firm* — ScienBiziP, P.C.

(57) ABSTRACT

A waterproof button for an electronic device includes a button portion and a waterproof portion. The button portion includes an operating portion, a connecting portion, and a pressing portion. The waterproof portion includes a positioning portion, a sleeve, and a receiving portion. The positioning portion defines a through hole to allow the connecting portion to pass through. The sleeve is connected to the positioning portion to receive the connecting portion, the receiving portion is connected to the sleeve to receive the pressing portion. A surface of the positioning portion forms a fixing surface. When the waterproof button is mounted to the electronic device, the fixing surface is fixed to the electronic device. An electronic device using the waterproof button is also described.

14 Claims, 4 Drawing Sheets

(56) References Cited

U.S. PATENT DOCUMENTS

| | | | | |
|---|---|---|---|---|
| 8,519,286 | B1 * | 8/2013 | Bloch | G06F 3/044<br>200/302.2 |
| 2009/0020402 | A1 * | 1/2009 | Ichikawa | H01H 13/06<br>200/341 |

* cited by examiner

WATERPROOF BUTTON AND ELECTRONIC DEVICE USING SAME

CROSS-REFERENCE TO RELATED APPLICATIONS

This application claims priority to Chinese Patent Application No. 201610189823.2 filed on Mar. 30, 2016.

FIELD

The subject matter herein generally relates to waterproofing of controls, and particularly to a waterproof button and an electronic device using the waterproof button.

BACKGROUND

Operation buttons are widely used in electronic products, such as smart watches, smart glasses, mobile phones, and flat computers. Waterproofing is important for the operation buttons.

BRIEF DESCRIPTION OF THE DRAWINGS

Implementations of the present technology will now be described, by way of example only, with reference to the attached figures.

DETAILED DESCRIPTION

Figure 1:
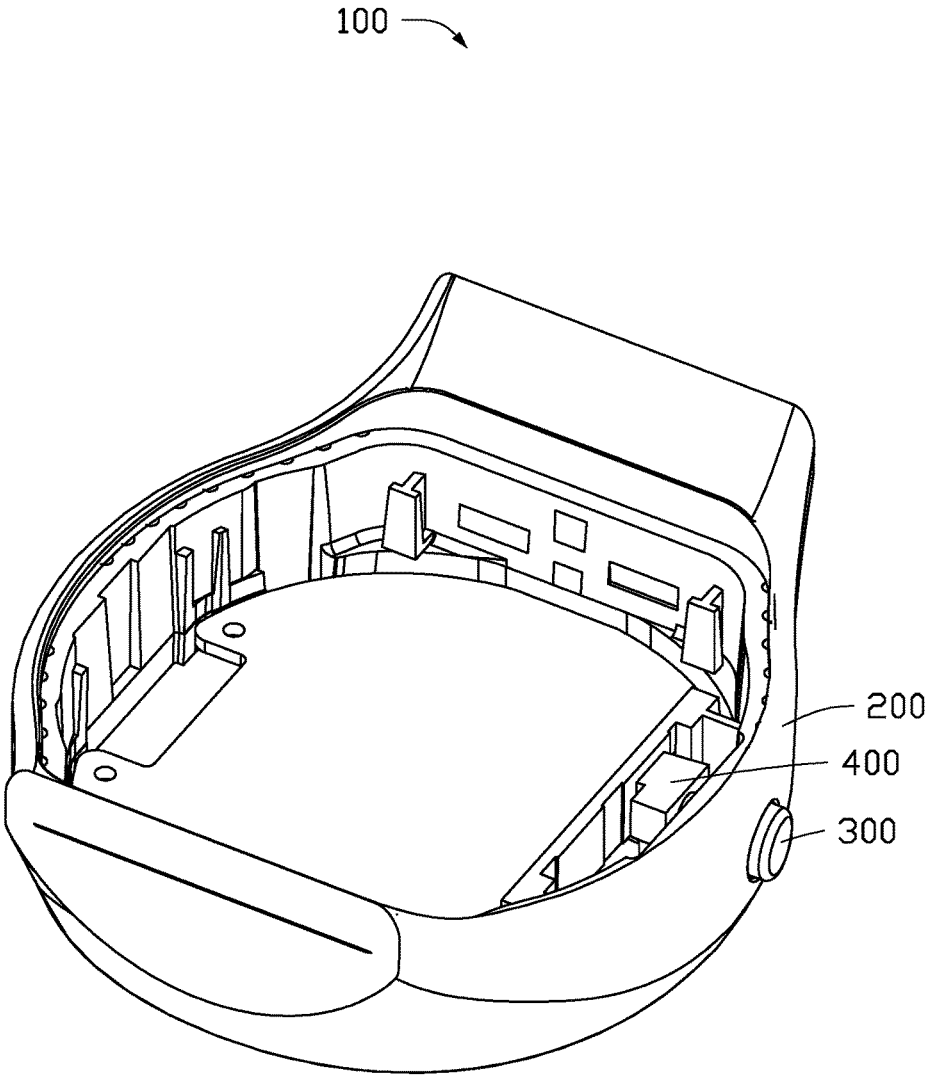
FIG. 1 is an isometric view illustrating an embodiment of an electronic device having a waterproof button.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to", it specifically indicates open-ended inclusion or membership in a so-described combination, group, series and the like.

Figure 4:
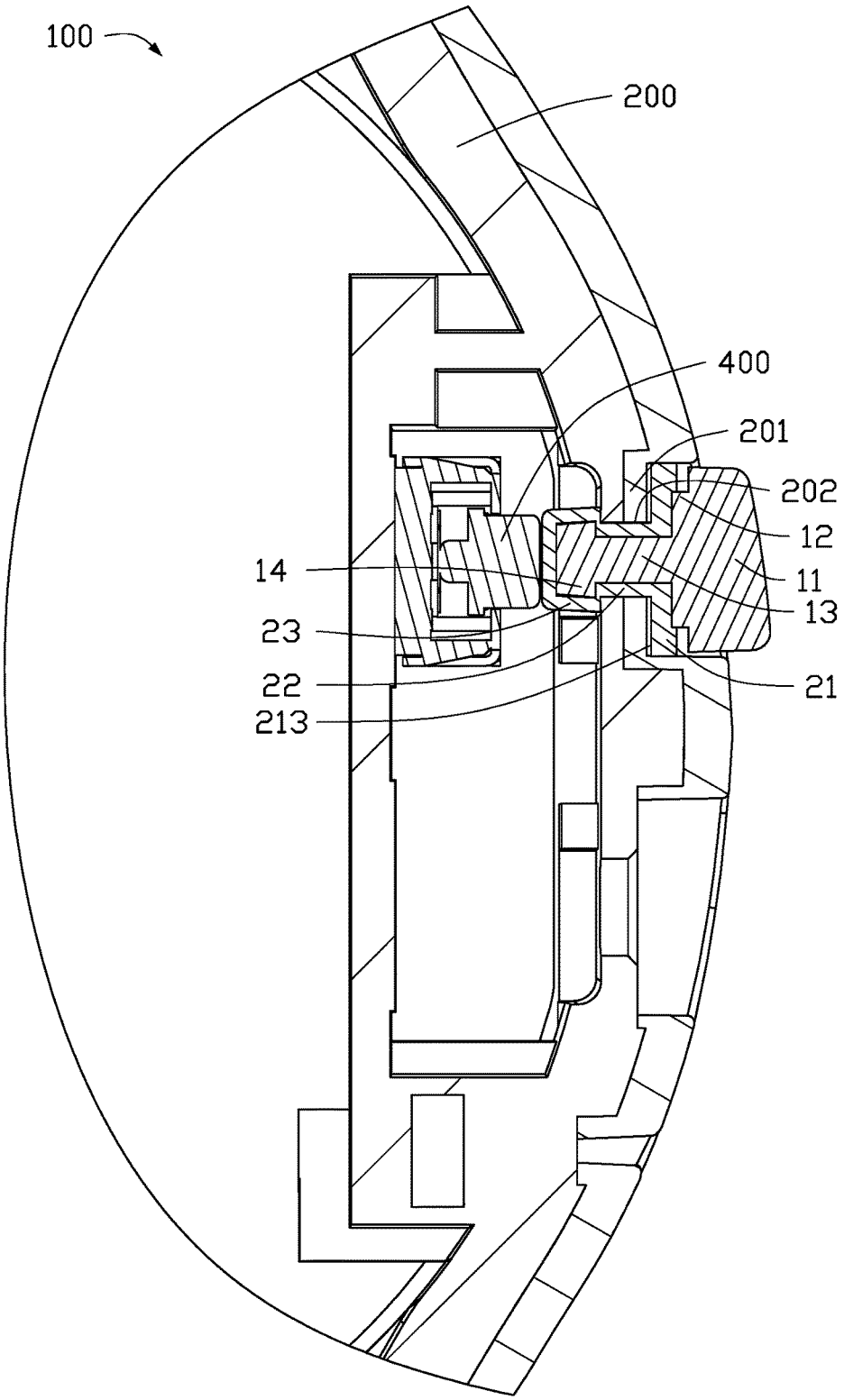
FIG. 4 is a cross sectional view of the waterproof button of FIG. 2.

FIG. 1 illustrates an electronic device 100. In the embodiment, the electronic device 100 at least includes a casing 200, a waterproof button 300, and a circuit trigger 400. The trigger 400 is mounted in the casing 200. Referring to FIG. 4, the casing 200 defines a receiving groove 201 to receive the waterproof button 300. An opening 202 is defined in a wall of the receiving groove 201, one end of the waterproof button 300 passes through the opening 202 and resists against the trigger 400. When the waterproof button 300 is pressed by a user, the waterproof button 300 presses on the trigger 400, thus the trigger 400 can trigger functions of the electronic device 100. In the embodiment, the electronic device 100 can be smart glasses, a smart watch, a smart phone, a flat computer, and the like. The electronic device 100 includes many other elements not shown which are not relevant to this application.

Figure 2:
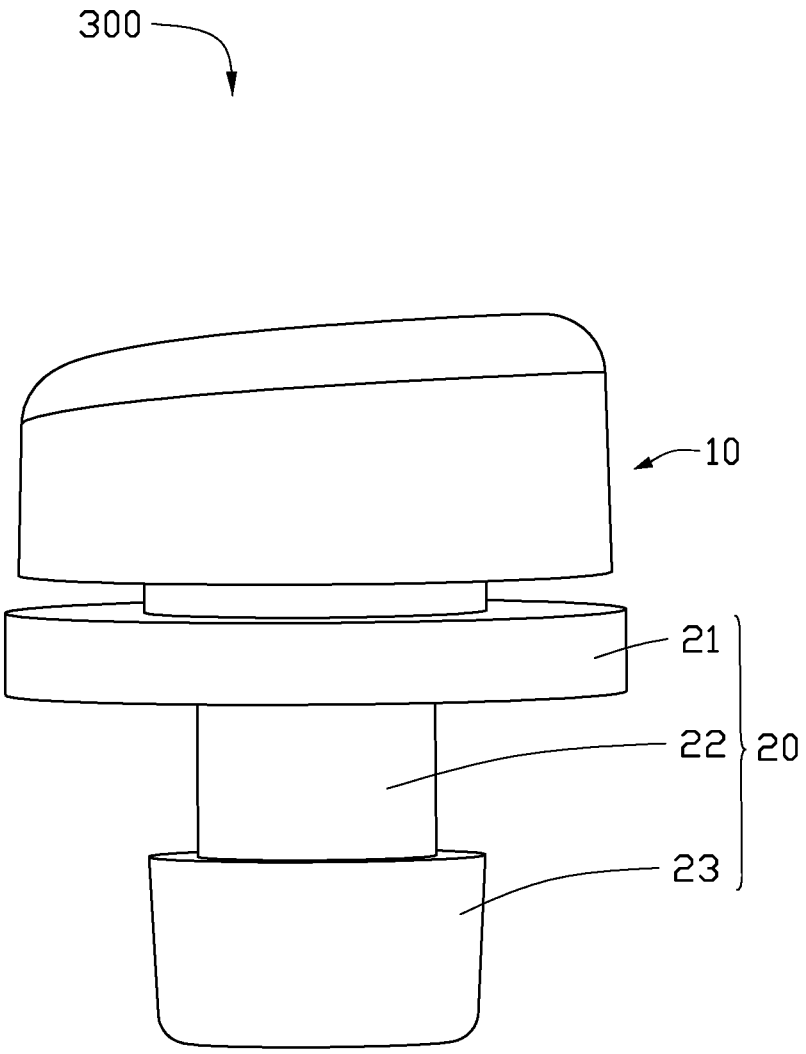
FIG. 2 is an isometric view illustrating an embodiment of the waterproof button of FIG. 1.
Figure 3:
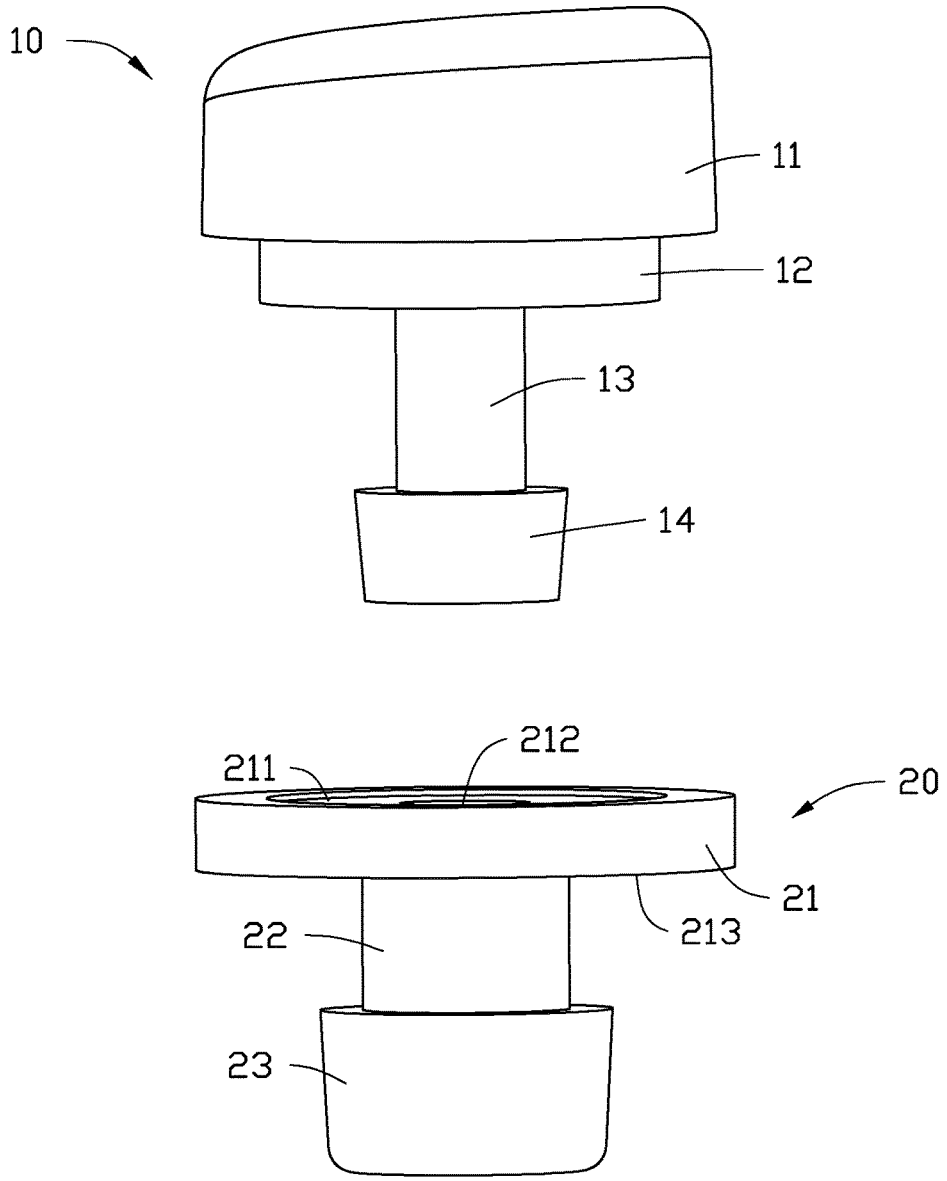
FIG. 3 is an exploded view of the waterproof button of FIG. 2.

Referring to FIG. 2 and FIG. 3, in the embodiment, the waterproof button 300 can include a button portion 10 and a waterproof portion 20.

The button portion 10 includes an operating portion 11, a first connecting portion 12, a second connecting portion 13, and a pressing portion 14.

In the embodiment, the operating portion 11 is configured for a user to press the button portion 10 with his fingertip. In this embodiment, the operating portion 11 is cylindrical. It can be understood that the operating portion 11 also can be made into various other shapes for other embodiments.

The first connecting portion 12 is connected between the operating portion 11 and the second connecting portion 13. A diameter of the first connecting portion 12 is less than a diameter of the operating portion 11, and a diameter of the second connecting portion 13 is less than the diameter of the first connecting portion 12. In the embodiment, the first connecting portion 12 and the second connecting portion 13 are cylindrical. It can be understood that, in other embodiments, the first connecting portion 12 and the second connecting portion 13 can be replaced by an integral cylinder, and the diameters of the first connecting portion 12 and the second connecting portion 13 would be the same.

The pressing portion 14 is connected to the second connecting portion 13. In the embodiment, the pressing portion 14 is cylindrical, and the diameter of the pressing portion 14 is greater than the diameter of the second connecting portion 13.

The button portion 10 is made of a hard material. In the embodiment, the hard material can be resin or polyvinyl chloride (PVC). In other embodiment, the hard material can include metal, ceramic, and the like.

In the embodiment, the waterproof portion 20 can include a positioning portion 21, a sleeve 22, and a receiving portion 23.

The positioning portion 21 is a flat ring plate. A groove 211 is defined on a top surface of the positioning portion 21, a shape of the groove 211 is the same as a shape of a cross section of the first connecting portion 12. A through hole 212 is defined in the center of the groove 211, and the shape of the through hole 212 is the same as the shape of a cross section of the second connecting portion 13. The second connecting portion 13 can thus pass through the through hole 212, and the first connecting portion 12 can be received in the groove 211. A bottom surface of the positioning portion 21 forms a fixing surface 213. When the waterproof button 300 is mounted to the electronic device 100, the fixing surface 213 is fixed to the casing 200. In this embodiment, the fixing surface 213 is fixed to the receiving groove 201 of the casing 200 by adhesive. It can be understood that, in other embodiments, the fixing surface 213 further can be fixed to the casing 200 by using screws or other means.

The sleeve 22 receives the second connecting portion 13. One end of the sleeve 22 is connected to the fixing surface 213, and a hollow portion of the sleeve 22 is in communication with the through hole 212 of the positioning portion 21. An inner diameter of the sleeve 22 is equal to the diameter of the second connecting portion 13.

The receiving portion 23 is connected to the other end of the sleeve 22. The receiving portion 23 forms a cavity communicating with the hollow portion of the sleeve 22. The receiving portion 23 receives the pressing portion 14 of the button portion 10, and a shape of the receiving portion 23 is the same as the shape of the pressing portion 14.

The waterproof portion 20 is made of elastic material which is waterproof. In the embodiment, the waterproof portion 20 is made of flexible and adhesive materials, such as rubber, Polyethylene (PE), or Polypropylene (PP).

In the embodiment, the button portion 10 and the waterproof portion 20 are made by injection molding.

In other embodiments, the button portion 10 and the waterproof portion 20 can be manufactured separately, and then be assembled together. In detail, the assembly can include the pressing portion 14 and the second connecting portion 13 being passed through the through 212 of the positioning portion 21 and the sleeve 22 until the pressing portion 14 is received in the receiving portion 23. Simultaneously, the first connecting portion 12 is received in the groove 211.

When mounting the waterproof button 300 to the casing 200, the receiving portion 23 and the sleeve 22 firstly passes through the opening 202 of the casing 200 until the receiving portion 23 resists against the trigger 400 and the fixing surface 213 is received in the receiving groove 201. The fixing surface 213 can be fixed to the receiving groove 201 by adhesive. Thus, the casing 200 and the waterproof button 300 are tightly connected, preventing the ingress of water or vapor or dust and dirt.

In use, the operating portion 11 transmits the fingertip pressure to the first connecting portion 12 and the pressing portion 14, the first connecting portion 12 presses the groove 211 to compress the groove 211. The pressing portion 14 presses and compresses the receiving portion 23, and the receiving portion 23 presses on the trigger 400 to trigger a function of the electronic device 100. When the user releases the operating portion 11, the elastic restoring force of the waterproof portion 20 brings the button portion 10 to the original state.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. A waterproof button applied in an electronic device, the waterproof button comprising:

a button portion, comprising an operating portion, a first connecting portion, a second connecting portion, and a pressing portion; and a waterproof portion made entirely of elastic waterproof material, comprising a positioning portion, the positioning portion defining a through hole allowing the second connecting portion to pass through, a surface of the positioning portion forming a fixing surface;

a sleeve connected to the positioning portion to receive the second connecting portion, a hollow portion of the sleeve communicating with the through hole; and a receiving portion connected to the sleeve, and having a cavity to receive the pressing portion of the button portion;

wherein when the waterproof button is mounted to the electronic device, the fixing surface is fixed to the electronic device.

2. The waterproof button according to claim 1, wherein the button portion is made of a hard material.

3. The waterproof button according to claim 1, wherein the button portion and the waterproof portion are made by injection molding.

4. The waterproof button according to claim 1, wherein the fixing surface is fixed to the electronic device by adhesive.

5. The waterproof button according to claim 1, wherein the operating portion, the first connecting portion, the second connecting portion, and the pressing portion are connected in turn, a diameter of the first connecting portion is greater than a diameter of the second connecting portion.

6. The waterproof button according to claim 5, wherein the positioning portion further defines a groove to receive the first connecting portion.

7. The waterproof button according to claim 5, wherein the diameter of the second connecting portion is less than an inner diameter of the sleeve.

8. An electronic device comprising:

a casing defining an opening;

a trigger for triggering a corresponding function of the electronic device; and a waterproof button passing through the opening to resist against the trigger, the waterproof button comprising:

a button portion, comprising an operating portion, a first connecting portion, a second connecting portion, and a pressing portion; and a waterproof portion made entirely of elastic waterproof material, comprising a positioning portion, the positioning portion defining a through hole allowing the second connecting portion to pass through, a surface of the positioning portion forming a fixing surface;

a sleeve connecting the positioning portion for receiving the second connecting portion, a hollow portion of the sleeve communicating with the through hole; and a receiving portion connected to the sleeve, and having a cavity for receiving the pressing portion of the button portion;

wherein when the waterproof button is mounted to the electronic device, the fixing surface is fixed to the casing of the electronic device.

9. The electronic device according to claim 8, wherein the button portion is made of a hard material.

10. The electronic device according to claim 8, wherein the button portion and the waterproof portion are made by injection molding.

11. The electronic device according to claim 8, wherein the fixing surface is fixed to the electronic device by adhesive.

12. The electronic device according to claim 8, wherein the operating portion, the first connecting portion, the second connecting portion, and the pressing portion are connected in turn, a diameter of the first connecting portion is greater than a diameter of the second connecting portion.

13. The electronic device according to claim 12, wherein the positioning portion further defines a groove to receive the first connecting portion.

14. The electronic device according to claim 12, wherein the diameter of the second connecting portion is less than an inner diameter of the sleeve.

* * * * *